United States Patent [19]

Barongan

[11] Patent Number: 4,951,592

[45] Date of Patent: Aug. 28, 1990

[54] PROCESS OF FORMING A BOAT ANCHOR

[76] Inventor: Narciso P. Barongan, 501 Sterling Rd., Virginia Beach, Va. 23464

[21] Appl. No.: 355,323

[22] Filed: May 22, 1989

[51] Int. Cl.[5] ..... B63B 21/24

[52] U.S. Cl. ..... 114/294

[58] Field of Search ..... 114/293, 294, 300

[56] References Cited

U.S. PATENT DOCUMENTS

| | | | |
|---|---|---|---|
| 2,464,661 | 3/1949 | Woodland | 114/300 |
| 3,158,127 | 11/1964 | Gallaugher | 114/300 |
| 4,563,972 | 1/1986 | Poppe | 114/293 |

OTHER PUBLICATIONS

Popular Science, Mar. 1956, p. 108.

*Primary Examiner*—Joseph F. Peters, Jr.
*Assistant Examiner*—Jesus D. Sotelo
*Attorney, Agent, or Firm*—Leon Gilden

[57] ABSTRACT

A process of forming a boat anchor is set forth including utilizing a polymeric carbonate beverage container of a typical two liter configuration defined by an elongate cylindrical body with convex ends and a threaded opening coaxially aligned with an upper end and a removably mounted support stand. The support stand is removed from the container whereupon the container is subsequently filled with a concrete mixture. An eye hook is directed through the opening and upon the concrete mixture curing, a typically ten pound anchor is developed. Modifications of the instant invention include the step of threadedly directed a threaded eye hook through a bottom end of the anchor opposed to the upper eye hook with the eye hooks coaxially aligned with one another to enable a plurality of anchors to be secured together in end to end relationship. Yet another modification utilizes an elongate plate with an orthogonally directed threaded boss threadedly directed through and coaxially aligned with the upper eye hook for forming an anchor that may imbed itself within a bottom surface to prevent shifting of the anchor during rolling seas. A still further modification of the instant invention utilizes the additional step of directing laterally positioned eye hooks orthogonally relative to the axis of the container in addition to a bottom eye hook to enable securement of the anchors in various patterns.

1 Claim, 3 Drawing Sheets

PROCESS OF FORMING A BOAT ANCHOR

BACKGROUND OF THE INVENTION 1.0 Field of the Invention

The field of invention relates to boat anchors, and more particularly pertains to a new and improved process of forming a boat anchor wherein the same utilizes conventional carbonated beverage containers to form anchors and groups thereof.

2.0 Description of the Prior Art

The use of boat anchors in various configurations to accommodate various boating conditions is known in the prior art. The prior art, however, has utilized anchors of complex or costly construction limiting their advantageous use by individuals. For example, U.S. Pat. No. 3,187,705 to Costello sets forth a boat anchor wherein the same, upon deposit onto an ocean floor, directs an internally mounted shaft to penetrate the ocean floor with outwardly extending legs for embedding within the floor and maintaining secure anchoring therewithin.

U.S. Pat. No. 2,841,916 to Ueda sets forth a sinker arrangement utilizing a conically configured sinker with outwardly depending legs orthogonally aligned to an axis of the sinker with an eye hook embedded through an apex of the sinker for securement to a fishing line.

U.S. Pat. No. 3,754,524 to Locks sets forth an anchoring device utilizing a plastic dipped iron body with a flange directed orthogonally outwardly and medially of the elongate body for grasping of a bottom surface.

U.S. Pat. No. 3,659,544 to Goepfrich sets forth an anchor of generally conical configuration with an "O" ring groove and an "O" ring directed through the groove which projects beyond an outer surface of the body to provide a bumper to protect the sides of boats against damage as the anchor is swung onto the sides of boats.

U.S. Pat. No. 704,730 to Zierleyn sets forth a hitching device utilizing an elongate base and an upwardly tapered body with an eye hook secured thereto of a generally anchor-like configuration.

As such, it may be appreciated that there is a continuing need for a new and improved process of forming a boat anchor which addresses both the problems of ease of fabrication and effectiveness in construction, and in this respect, the present invention substantially fulfills this need.

SUMMARY OF THE INVENTION

In view of the foregoing disadvantages inherent in the known types of boat forming anchor processes now present in the prior art, the present invention provides a boat forming anchor process wherein the same utilizes conventional liter containers filled with a cementitious material with projecting hardware therein to provide an efficient and effective anchoring arrangement. As such, the general purpose of the present invention, which will be described subsequently in greater detail, is to provide a new and improved boat anchor forming process which has all the advantages of the prior art boat anchor forming processes and none of the disadvantages.

To attain this, the present invention utilizes a boat forming anchor process comprising the steps of providing a conventional two liter polymeric beverage container with subsequent removal of the support stand, the container is filled with a cement mix material to completely fill the interior volume of the container with subsequent projecting of an eye hook through the associated threaded opening of the container. A modification utilizes a screw-threaded lower eye hook coaxially aligned with and directed outwardly of the bottle and secured within the cementitious material prior to curing to enable a stringing of such anchoring devices together. Yet a further modification of the instant invention comprises the step of providing a planar plate formed with an orthogonally projecting threaded screw shank that is directed coaxially aligned through a lowermost end of the container and aligned with the upper eye hook. A still further modification utilizes the process of directing laterally positioned hooks through side walls of the container orthogonally relative to an axis of the container in conjunction with an upper and lower coaxially aligned eye hook to enable a patterned stringing of such anchor members together.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved process of forming boat anchors which has all the advantages of the prior art process of forming boat anchors and none of the disadvantages.

It is another object of the present invention to provide a new and improved process of forming boat anchors which may be easily and efficiently manufactured and marketed.

It is a further object of the present invention to provide a new and improved process of forming boat anchors which is of a durable and reliable construction.

An even further object of the present invention is to provide a new and improved process of forming boat anchors which is susceptible of a low cost of manufacture with regard to both materials and labor, and which accordingly is then susceptible of low prices of sale to the consuming public, thereby making such process of forming boat anchors economically available to the buying public.

Still yet another object of the present invention is to provide a new and improved process of forming boat anchors which provides in the apparatuses and methods of the prior art some of the advantages thereof, while simultaneously overcoming some of the disadvantages normally associated therewith.

Still another object of the present invention is to provide a new and improved process of forming anchors wherein the same employs economical and readily available material utilized in conjunction with one another to provide an efficient and effective anchor member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
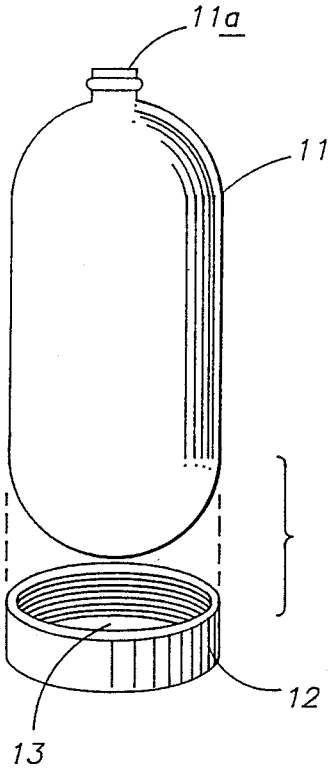
FIG. 1 is an isometric illustration setting forth a removal of the support stand associated with a conventional container.
Figure 2:
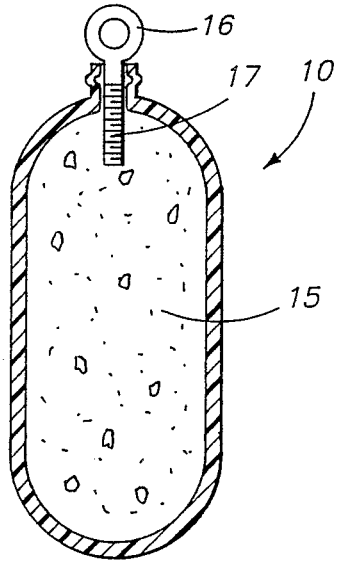
FIG. 2 is an orthographic cross-sectional view of the boat anchor formed by the process of the instant invention upon subsequent filling of the container with a cement material and the directing of an eye hook through a threaded opening of the container.
Figure 3:
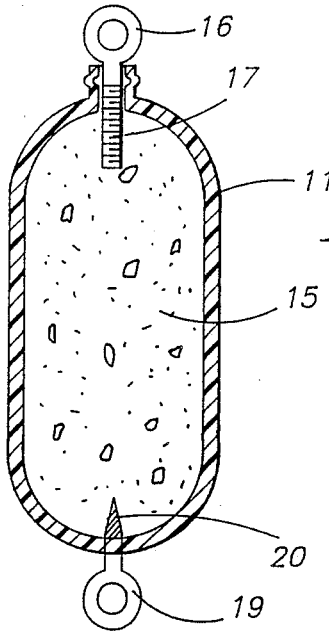
FIG. 3 is a cross-sectional view of a modification of the instant invention illustrating the further step of directing a screw threaded eye hook through a lowermost end of the bottle coaxially aligned with an upper eye hook.
Figure 4:
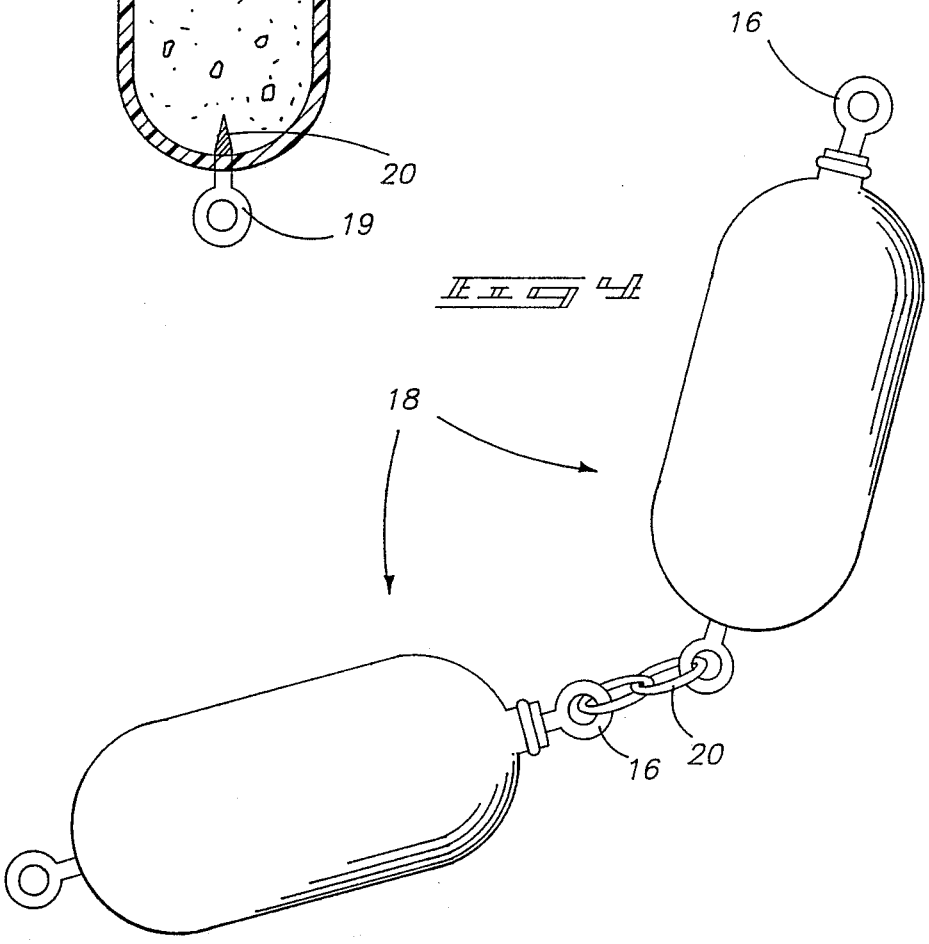
FIG. 4 is an isometric illustration of a plurality of the boat anchor members of FIG. 3 secured together.

With reference now to the drawings, and in particular to FIGS. 1 to 6 thereof, a new and improved process of forming a boat anchor embodying the principles and concepts of the present invention and generally designated by the reference numerals 10, 18, 22, and 25 will be described.

More specifically, it will be noted that the process of forming a boat anchor 10 essentially comprises providing a conventional two liter beverage container 11 formed with a convex upper and lower end symmetrically formed about an axis of the elongate cylindrical main body with a threaded opening 11*a* directed through and coaxially aligned with the container. The process includes the step of removal of the support stand 12 formed with a convex internal surface and its withdrawal from the bottom surface of the container 11. A concrete mixture 15, or other suitable cementitious mixture, is directed through the threaded opening 11*a* and completely fills the internal volume of the container 11. Subsequently, an upper eye hook 16 provided with a threaded shank of at least two inches in length is directed coaxially through the threaded opening and positioned within the concrete mixture 15 prior to a curing of the mixture 15.

Attention to FIG. 8 illustrates a first modification of the boat anchor with the additional step of threadedly directing a lower eye hook 19 formed with a screw threaded shank 20 through the bottom surface of the container 11 coaxially aligned with the threaded shank 17. In this manner, a further step may include the coupling of a series of the modified anchors 18 to provide additional weight as required by employment of coupling chain links 21 to secure various eye hooks together. The boat anchors 10 utilizing the tubular bottle are typically of approximately ten pounds in weight whereupon it may be desired to utilized a series of such bottles to employ additional weight for an anchor, as desired.

Figure 6:
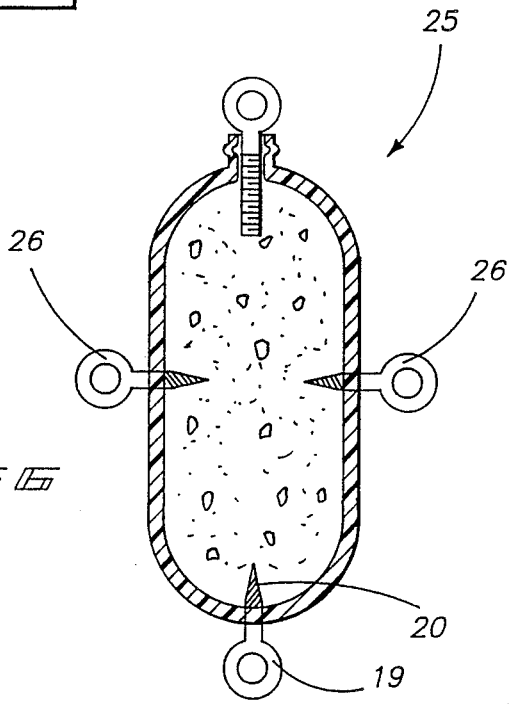
FIG. 6 is a further modification of the boat anchor, as illustrated in FIG. 3, further incorporating laterally positioned eye hooks orthogonally oriented relative to an axis of the container to enable a patterned securement of such anchor members together.

Attention to FIG. 6 illustrates a further step in developing a further modification 25 with a plurality of laterally positioned eye hooks 26, also formed with screw threaded shanks, wherein the laterally positioned eye hooks 26 are orthogonally aligned to an axis of the container 11 and aligned with one another to enable the formation of various patterns to minimize a rolling of the anchor portions 25 about a surface of the bottom floor of a body of water during turbulent water conditions.

Figure 5:
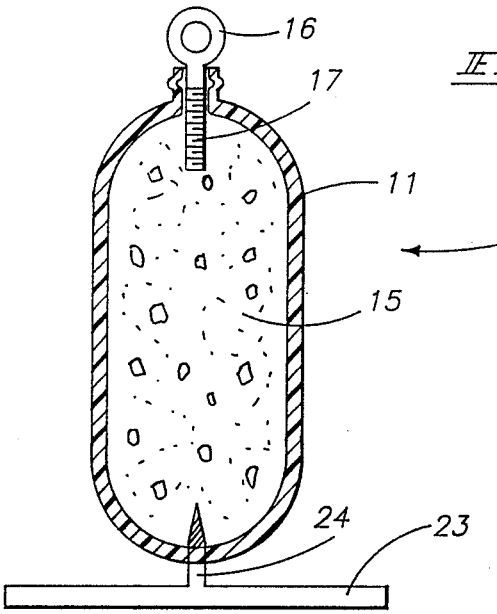
FIG. 5 is a cross-sectional illustration of a further modification of the instant invention with a plate formed with a screw threaded shank secured through a lowermost end of the bottle.

FIG. 5 illustrates a modified anchor 22 wherein in lieu of the lower eye hook 19, a plate member 23 formed with a medially positioned and orthogonally outwardly directed screw stud 24 is threaded through a bottom end of the container 11 prior to the curing of the concrete mixture 15. The plate member 23 will accordingly grasp a bottom surface to be anchored into, wherein the plate allows itself to "dig in" into that bottom surface and minimize a shifting of a boat utilizing the anchor during rough or rolling water conditions. Further, it should be understood that the various hardware, such as the upper and lower hooks 16 and 19 as well as the lateral hooks 26 and the plate member 23, are all formed of a corrosion resistant material, particularly stainless steel and the like.

The manner of forming the boat anchor of the instant invention should be apparent from the above description, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A process of forming a boat anchor comprising the steps of, providing an elongate beverage container including an elongate cylindrical body formed with an integral convex upper and lower end each symmetrically formed about an axis of the cylindrical body, and the upper end including an axially aligned opening formed therethrough, and completely filling the container with a cementitious material and directing said material through the opening, and providing an eye hook formed with a threaded shank, and forcing the shank through the opening and into the cementitious material coaxially aligned with axis of the cylindrical body, and permitting the cementitious material to cure, and wherein the beverage container is formed with a support stand secured coaxially with the lower end of the container in a surrounding relationship thereto, wherein the method further includes the step of removing the support stand prior to the filling of the container, and further including the step of providing a lower eye hook formed with a screw threaded shank, and directing the screw threaded shank through the lower end coaxially aligned with the threaded shank through the lower end coaxially aligned with the threaded shank prior to curing of the cementitious material, and including the step of forming a plurality of boat anchors and securing an outwardly extending eye hook from each of the boat anchors together, and including the step of directing a plurality of laterally positioned eye hooks orthogonally through the cylindrical body orthogonally relative to the axis of the cylindrical body and coaxially aligning the eye hooks relative to one another prior to the curing of the cementitious material.

* * * * *